United States Patent [19]

Bowen et al.

[11] 4,404,995

[45] Sep. 20, 1983

[54] HEDDLE FRAME ASSEMBLY CONSTRUCTION AND METHOD

[75] Inventors: James B. Bowen; Charles F. Kramer, both of Greenville, S.C.

[73] Assignee: Steel Heddle Manufacturing Co., Greenville, S.C.

[21] Appl. No.: 252,859

[22] Filed: Apr. 10, 1981

[51] Int. Cl.[3] ..... D03C 9/06; B23P 11/00

[52] U.S. Cl. ..... 139/92; 29/509; 29/522 R

[58] Field of Search ..... 139/92, 81, 91; 29/509, 29/522 R

[56] References Cited

U.S. PATENT DOCUMENTS

| | | | |
|---|---|---|---|
| 321,260 | 6/1885 | Tillutson | 29/509 UX |
| 3,114,031 | 12/1963 | Dash | 29/509 R |
| 3,151,634 | 10/1964 | Kaufmann | 139/92 |
| 4,106,529 | 8/1978 | Kaufmann | 139/92 |

FOREIGN PATENT DOCUMENTS

| | | | |
|---|---|---|---|
| 2610311 | 9/1977 | Fed. Rep. of Germany | 139/92 |
| 318436 | 9/1929 | United Kingdom | 29/509 |

*Primary Examiner*—James Kee Chi

*Attorney, Agent, or Firm*—Dority & Flint

[57] ABSTRACT

An assembly and method for a heddle frame A for a weaving loom is disclosed wherein the heddle rod 20 upon which the end eyes of the heddles H are hooked and travel is more securely and reliably attached to the slat 12 of the heddle frame. The assembly and method includes a plurality of studs 24 having a uniform effective rivet length welded at spaced intervals to the rod 20 which are then inserted into countersink openings 28 in the ledge 18 of the slat 12 and headed therein for a more accurate and reliable rivet connection. The face 20*a* of the heddle is smooth and completely unbroken to reduce wear between the heddles and rod.

5 Claims, 8 Drawing Figures

HEDDLE FRAME ASSEMBLY CONSTRUCTION AND METHOD

BACKGROUND OF THE INVENTION

This invention relates to heddle frames for weaving looms and more particularly to improvements in their construction in the attachment of heddle supporting rods to the heddle frames.

Heretofore, it has been common in the weaving art to employ heddle frames having rods on which the heddles are mounted. These rods are typically made of steel strips with a cross-section which facilitates mounting on the frame and on which the end eyes of the heddles are freely movable. An illustration of such heddle rods is in U.S. Pat. Nos. 3,417,788 and 4,106,529. These patents show the heddle rods being riveted at their faces to the heddle frame slats and joined at their end to the side struts of the heddle frame.

During shedding operations on a weaving loom, the heddle frame reciprocates vertically in rather short, rapid strokes with the warp yarns threaded through the center eye of the heddle. The warps are thus lifted up and down. The dynamic forces on the heddle frames and their assembly parts are large during the shedding motions. With the advent of high speed looms, such as water-jet looms, the vertical reciprocation of the heddle frame occurs at even higher speeds resulting in even larger accelerations and dynamic forces on the heddle frame. Thus, the parts and connections in the heddle frame assembly are subjected to larger stress and fatigue forces than ever encountered in shuttle looms. This has required more reliable and accurate construction of the heddle frame assembly to eliminate weak spots.

In particular, the heddle rods have been, heretofore, riveted to the slats of the heddle frame by conventional methods in which a countersink opening is formed in the face of the heddle rod and the corresponding surface of the heddle frame slat against which the rod mates. A rivet is peened or headed on both ends within the countersink openings to form a conventional rivet connection between the members. However, inaccuracies in the heddle rod thickness and rivet countersink dimensions make this type of connection susceptible to failure. These dimensions are critical since the rivet is of a fixed length and amount. If any of these dimensions are beyond acceptable tolerances, the rivet material either fills the opening too much or too little. If the countersink opening is too small, excess rivet material forms a protruding rivet head which impairs free heddle travel over the face of the rod. If the opening is too deep, the rivet material either does not fill the opening completely or too much rivet material is used in the opening leaving an insufficient amount in the other opening resulting in an imperfect rivet head and weak connection.

Furthermore, even a properly headed rivet connection allows wobbling of the heddle rod about the connection which, after prolonged use, can become attenuated and lead to failure. The end eyes of the heddles often engage the rivet head exposed on the face of the heddle rod causing excess wear therebetween which leads to loosening of the rivet head.

Typically, the rivet must be held with a serrated anvil to prevent the rivet from turning during peening which can cause improper heading. However, deterioration of the serrated anvil also reduces the integrity of the rivet head connection.

SUMMARY OF THE INVENTION

Accordingly, an important object of the invention is to provide a heddle frame assembly having increased long-term dependability for use on high-speed shuttleless looms.

Another important object of the present invention is to provide a heddle frame wherein the heddle rod is provided with a smooth, unbroken face ensuring free travel of the heddles and reduced wear.

Another important object of the present invention is to provide a heddle frame assembly and method which eliminates inaccuracy in the riveting process and results in more accurate heddle frame construction which results in fewer rejects and less scrap.

Yet another important object of the present invention is to reduce the steps and inaccurracies involved in the manufacturing and assembling of heddle frames due to the elimination of piercing and countersinking of rivet holes.

Still another important object of the present invention is to provide a more stable and rigid connection between the heddle rod and heddle frame slats of the heddle frame assembly which reduces wobbling therebetween.

In accordance with the present invention the above objectives are accomplished by providing a rivet stud which is welded to the heddle rod to form an integral counstruction and stud of accurate dimension for insertion into a countersink opening in the heddle frame slat which is then riveted therein and which thus eliminates the presence of a countersink opening and rivet head in the heddle rod face and reduces the possibility of dimensioning variances.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

The invention relates to a method and construction for a heddle frame assembly of the type having top and bottom frame slats which support heddle rods on which end eyes of the heddles are slidably carried. Since the operation of heddle frames and weaving looms is well known in the art, only that portion of the heddle frame assembly necessary to understanding of the invention will be illustrated.

Figure 1:
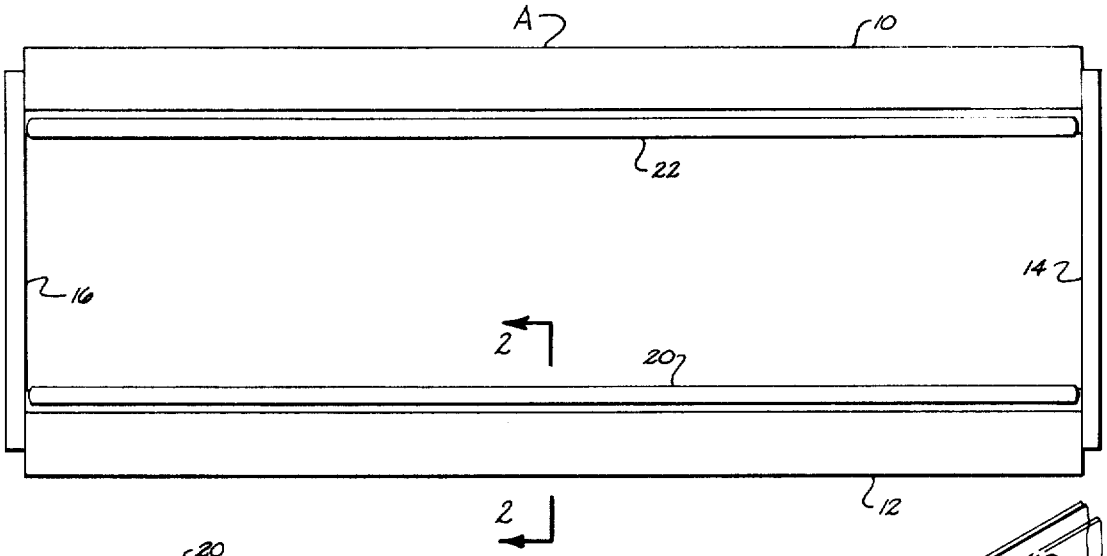
FIG. 1 is a front elevation illustrating a heddle frame assembly constructed according to the present invention.
Figure 2:
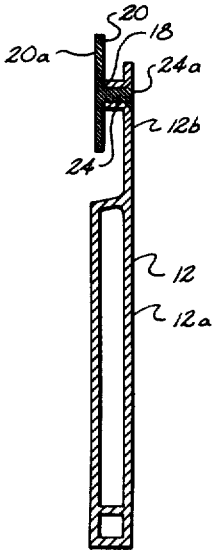
FIG. 2 is a sectional view taken along line 2—2 of FIG. 1.
Figure 3:
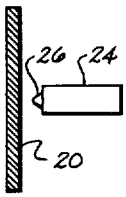
FIG. 3 is a side elevational view illustrating a heddle rod and weld-rivet stud utilized according to the invention.
Figure 4:
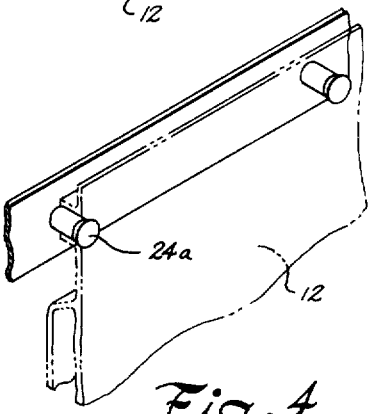
FIG. 4 is a perspective view illustrating the assembly of a heddle rod and heddle frame slat according to the invention.
Figure 3A:
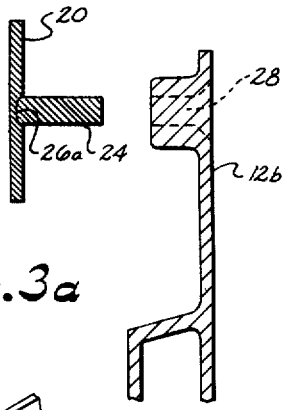
FIG. 3*a* is a side elevational view illustrating the heddle rod and rivet stud of FIG. 3 in a welded integral construction for unitary attachment to a countersink formed in the associated heddle frame slat according to the invention as seen in FIG. 2.
Figure 5:
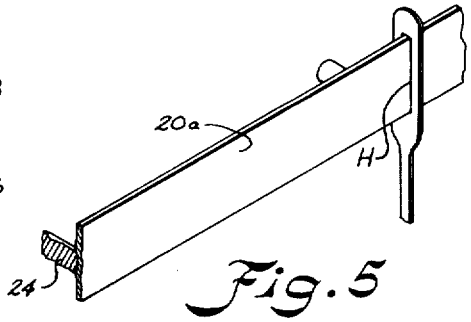
FIG. 5 is a perspective view illustrating a construction of the smooth, unbroken face of a heddle rod according to the invention.

FIG. 1 illustrates a heddle frame A having an upper heddle frame slat 10 and a lower heddle frame slat 12. The upper and lower slats are joined together by side struts 14 and 16. The frame slats 10 and 12 are preferably of an extruded tubular aluminum construction. The frame slats 10 and 12 are identical and, for example, slat 12 includes a tubular portion 12*a* and an extended neck portion 12*b* on which a ledge portion 18 is carried extending outwardly to provide a space for the end eyes of the heddles H to fit over heddle rods 20 and 22.

According to the invention, the heddle rods 20, 22 are attached to the respective frame slats in an identical manner which includes providing studs 24 which are welded to the heddle rods, such as 20, at spaced intervals along the length. Corresponding countersink openings 28 are spaced and formed in the ledge means 18 along the width of neck portion 12*b* of the heddle frame slat 12. As illustrated, studs 24 are in the form of a weld-rivet stud having a pointed projection 26 at one end consisting of metal which can be welded by conventional capacitor discharge welding techniques to the heddle rod. When rivet studs 24 are integrally welded to the heddle rod 20, a weld pocket 26*a* is formed in the rod back surface by molten metal 26 which makes the stud 24 and rod 20 integral and unitary as one piece. The opposing end of the stud 24 is suitable for peening to make a rivet head. In this manner, the effective length of the stud as a rivet connection is maintained since no stud material is consumed in the weld joint nor is any material left standing between the end of the stud and rod back surface to alter this length which projects in the countersink openings 28 assuring a reliable dimension and uniform filling thereof to provide a proper rivet head. The stud is preferably stainless steel to reduce corrosion when used on a water-jet loom. Typically 20 of such studs are spaced across the rod.

The heddle rod is attached to the neck 12*b* of the frame slat by placing the studs 24 in the corresponding opening 28. Next, the ends of the studs 24 are peened and headed to form a rivet head at 24*a* which rivets the rod securely to the neck of the frame slat. Thus, assuming studs 24 to be of standard length, only the thickness through the ledge 18 and the dimension of countersink 28 need be accurately determined to assure a proper rivet heading and connection so as to eliminate weak points.

Figure 6:
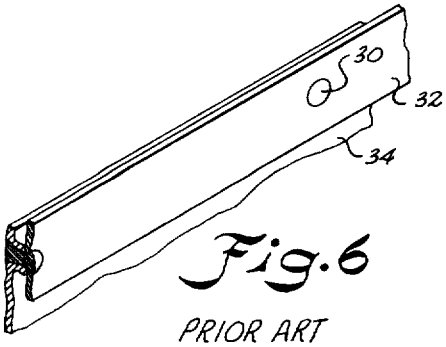
Fig. 6 PRIOR ART
FIG. 6 is a perspective view illustrating the face of a riveted heddle rod constructed according to the prior art.
Figure 7:
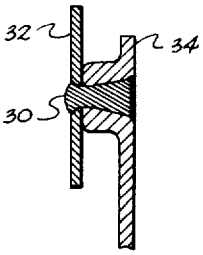
Fig. 7 PRIOR ART
FIG. 7 is a side sectional view of the riveted construction of the prior art heddle rod and heddle frame assembly of FIG. 6.

The elimination of a countersink and rivet head on the face of rod 32 eliminates a source of dimension variation as occurs in prior art FIGS. 6 and 7 wherein a countersink is required in the face of rod 32. The step of polishing and deburring the face 32 is eliminated.

The face of the rod 20 over which the heddle H travels is smooth and unobstructed so as to insure free travel of the heddles. A more rigid frame assembly is provided which virtually eliminates wobbling of the rod due to large forces or a loose connection between a rivet head 30 and heddle rod 32 as in the prior art construction. Furthermore, turning of the rivet is eliminated during the peening operation without use of a serrated anvil.

Most important, however, is that it has been found that this assembly and method for a heddle frame construction results in a more accurtely dimensioned and constructed frame wherein the connections between the heddle support rod and frame slat are more uniform in strength. Continued performance on high speed, shuttleless looms tends to bring out the presence of a weak rivet connection resulting in failure of that connection which is substantially eliminated herein.

While a preferred embodiment of the invention has been described using specific terms, such description is for illustrative purposes only, and it is to be understood that changes and variations may be made without departing from the spirit or scope of the following claims.

What is claimed is:

1. A method of constructing a heddle frame assembly to eliminate dimensional variations in the assembly and increase the integrity thereof wherein the heddle frame assembly is of the type having top and bottom frame slats on which heddle rods are affixed on which end eyes of the heddles are slidably carried, wherein the improvement comprises:

welding a plurality of studs having a uniform effective rivet length to said heddle rods at spaced intervals along the length thereof providing an integral unitary construction therebetween and eliminating dimensional variations in said assembly due to variations in the thickness of the heddle rods and in the depth of countersinks in the face thereof;

providing corresponding spaced uniformly dimensioned countersink openings in a portion of said frame slats for receiving said studs;

placing said studs into said openings;

peening the ends of said studs in said openings to form a rivet head and secure rivet connection between each said heddle rod and corresponding heddle frame slat;

whereby a more rigid and accurate construction and assembly is provided which eliminates weak connection points and affords a smooth face for free wear-resistant heddle travel along the length of said heddle rod.

2. The method of claim 1 wherein said studs are provided with smooth ends opposite said weld ends which are malleable for forming a rivet head.

3. The method of claim 1 including welding said studs to said heddle rods to create a weld pocket in said rod back surface which serves to unite said stud and rod in a unitary manner.

4. The method of claim 1 including providing said studs in predetermined lengths having a pointed projection on one end which forms a weld pocket whereby the length of said stud is unchanged after welding.

5. A heddle frame assembly of the type which includes top and bottom frame slats on which are affixed heddle rods which slidably support the end eyes of the heddles wherein the improvement comprises:

a plurality of studs having a standard effective length for forming a rivet;

a pointed projection carried at one end of each said stud;

said studs being welded to said rods at spaced intervals over the length thereof in a manner in which the effective length of said studs is unchanged providing uniform spacing between said heddle rod and frame slat affixed thereto;

a plurality of correspondingly spaced uniformly dimensioned countersink openings formed in said heddle frame slat;

said heddle rod and slat being integrally formed by heading said studs in said countersink openings to provide an accurately dimensioned rivet connection and reliable assembly; and the face of said heddle rod being smooth and completely unbroken facilitating free travel of the end eyes of said heddles thereover;

whereby dimensional variations in the thickness of the heddle rod and countersinks formed in the face thereof are eliminated in the construction of said assembly increasing the structural integrity thereof.

* * * * *